US005531844A

United States Patent [19]

Brown et al.

[11] Patent Number: 5,531,844

[45] Date of Patent: Jul. 2, 1996

[54] ENERGETIC COMPOSITIONS CONTAINING NO VOLATILE SOLVENTS

[75] Inventors: Jerry S. Brown, Woodford, Va.; John A. Conkling, Chestertown, Md.

[73] Assignee: The United States of America as represented by the Secretary of the Navy, Washington, D.C.

[21] Appl. No.: 195,249

[22] Filed: Feb. 14, 1994

[51] Int. Cl.[6] ..... C06B 45/10

[52] U.S. Cl. ..... 149/19.3; 149/87; 149/19.92

[58] Field of Search ..... 149/19.3, 2, 7, 149/21, 87, 108.2, 116, 19.92; 102/37.8, 289, 202.7; 428/335; 525/199, 337

[56] References Cited

U.S. PATENT DOCUMENTS

| | | | |
|---|---|---|---|
| 3,163,113 | 12/1964 | Davis et al. | 102/98 |
| 3,203,171 | 8/1965 | Burke, Jr. et al. | 60/35.4 |
| 3,914,139 | 10/1975 | Jones et al. | 149/19.2 |
| 3,983,816 | 10/1976 | Cornia et al. | 102/37.8 |
| 4,062,709 | 12/1977 | Castaneda et al. | 149/19.3 |
| 4,432,816 | 2/1984 | Kennedy et al. | 149/19.3 |
| 4,445,947 | 5/1984 | Shaw, III et al. | 149/19.3 |
| 4,530,971 | 7/1985 | Geri et al. | 525/199 |
| 4,544,708 | 10/1985 | Moggi et al. | 525/337 |
| 4,979,999 | 12/1990 | Briere | 149/6 |
| 4,981,535 | 1/1991 | Hadermann et al. | 149/19.92 |
| 5,253,584 | 10/1993 | Allford | 102/202.7 |
| 5,351,619 | 10/1994 | Chan et al. | 102/289 |
| 5,415,932 | 5/1995 | Bishop et al. | 428/335 |

*Primary Examiner*—Charles T. Jordan
*Assistant Examiner*—John R. Hardee
*Attorney, Agent, or Firm*—James B. Bechtel

[57] ABSTRACT

Energetic compositions and the process for obtaining same for use as the ignitable composition in infrared-emitting decoy flares, for high-temperature ignition compositions, and the like, are disclosed. These compositions are attained by combining a fluorinated hydrocarbon, either in a liquid state or as a water emulsion, with a powdered metal fuel such as aluminum, magnesium, titanium or zirconium to yield volatile solvent free energetic compositions.

4 Claims, No Drawings

ENERGETIC COMPOSITIONS CONTAINING NO VOLATILE SOLVENTS

ORIGIN OF THE INVENTION

This invention was made jointly by a U.S. Navy employee and a consultant under a U.S. Navy contract and the U.S. Government, accordingly, has certain rights in the invention.

FIELD OF THE INVENTION

This invention relates generally to ignitable compositions, and relates specifically to energetic compositions containing no volatile solvents and to the solvent-free process of making the same from active metal fuels and fluorocarbons.

BACKGROUND OF THE INVENTION

Energetic mixtures based on the reaction between an active metallic element, such as magnesium or aluminum, and a solid fluorine-rich carbon compound, such as polytetrafluoroethylene (PTFE), are well known for use in infrared-emitting decoy flares and for high-temperature ignition compositions. The processing of these type compositions generally requires the use of a flammable liquid (acetone or hexane), and the unique physical properties of PTFE can make processing difficult.

A static electrical hazard has also been demonstrated in the processing of these materials which can result in spontaneous ignition and disastrous results. There have been a number of tragic explosions associated with the manufacturing of these compositions. Also, once blending has been achieved, the flammable solvent must be removed and recovered, adding to the cost of the manufacturing process. Clean air laws and standards prohibit releasing these volatile organic solvents directly into the environment.

It is therefore an object of the present invention to eliminate the use of organic solvents and provide a safer process of producing active metal/fluorocarbon energetic compositions.

Another object of the present invention is a safe process for making energetic compositions that are free of volatile solvents and require no volatile solvents in the manufacturing process.

A further object of the present invention is an ignitable composition formed of fluorinated hydrocarbons, combined with metal powders, to yield an energetic composition for use in flares, high temperature ignition compositions, and the like.

An additional object of the present invention is to provide energetic compositions that are free of volatile solvents.

SUMMARY OF THE INVENTION

According to the present invention, the foregoing and additional objects are attained by combining a fluorinated hydrocarbon, either in a liquid state or as a water emulsion, with a powdered metal fuel such as aluminum, magnesium, titanium or zirconium. The resulting mixture, when mixed in the proper proportions, yields an energetic composition that is free of volatile organic solvents, and adaptable for use as a high temperature ignition composition, in infrared-emitting decoy flares, and the like. The process disclosed herein use fluorocarbon liquids containing no additional solvents, or uses water-based fluorocarbon emulsions. No organic solvents are used and the energetic compositions obtained are therefore free of any volatile organic solvents.

DETAILED DESCRIPTION AND SPECIFIC EXAMPLES

A more complete appreciation of the invention and many of the attendant advantages thereof will be better understood when considered in connection with the specific Examples described hereinbelow.

EXAMPLE I

In this specific example, a liquid florocarbon, a liquid perfluorinated polyether (PFPE) having a molecular weight of approximately 5000 was employed. Liquid fluorocarbons of this type are marketed for use in the semi-conductor, electronics and aerospace industries as dielectrics and lubricants and are available, for example, under the trade name FOMBLIN YR, from AUSIMONT of Morristown, N.J.

A mixture of this 5000 molecular weight PFPE and a 3 to 10 micron size aluminum were combined in a weight ratio of 2.3 to 1.0. The resulting composition was readily ignitable. Other metal fuels, such as magnesium, titanium and zirconium are equally applicable for mixing with this PFPE to form high-energy composition. The heat of combustion for a stoichiometric combination of magnesium and this fluorocarbon liquid is −3.5 K cal/g.

EXAMPLE II

In another specific example, a liquid fluorocarbon (PFPE) having an average molecular weight of 2000 was mixed with 3 to 10 micron aluminum in a weight ratio of 2.3 to 1.0. This PFPE/aluminum mixture also was readily ignitable. Liquid perfluorinated polyether (PFPE) having an average molecular weight of 2000 is commercially available, for example, under the trade name GALDEN D-40 from AUSIMONT of Morristown, N.J.

EXAMPLE III

Another specific example involved combining a 5000 molecular weight PFPE with a micron-size polytetrafluoroethylene (PTFE). In this example, 2 parts by weight, of the PFPE liquid/PTFE solid mixture was placed in a crucible and one part by weight of a 3 to 10 micron aluminum cautiously added thereto. The mixture was then blended for several minutes to a homogenous, fluid consistency using a ceramic pestle. A sample of this blended material ignited readily from a piece of pyrotechnic safety fuse and burned with a bright white flame. The material retained its pliable character overnight, and remained readily ignitable. Premixed PFPE liquid/PTFE (micron size) solid of this type is available under the trade name FOMBLIN RT 15 GREASE from AUSIMONT of Morristown, N.J.

EXAMPLE IV

Another form of fluorocarbon applicable for practice of the present invention is a water-based fluorocarbon emulsion. These emulsions contain no organic solvents and are commercially available products currently used in chemical-resistant coating applications and also available, for example, from AUSIMONT of Morristown, N.J. under their trade name TECNOFLON TN LATEX.

In this example, a fluoroelastomer terpolymer latex was combined with a metal fuel. To four parts, by weight, of an emulsion of fluorinated terpolymer fluoroelastomer in water (minimum 70% solids, 68% fluorine content, by weight) was added one part, by weight, of a 3 to 10 micron size aluminum powder. The aluminum blended in readily, with stirring, to produce a paste-like mixture. The water was allowed to evaporate overnight, leaving a rubbery, pliable material that ignited readily and burned with considerable intensity.

The foregoing specific Examples are given as illustrative only and are not to be deemed as exhaustive. It is readily seen that the use of a liquid fluorocarbon, or a water-based fluorocarbon emulsion, in place of the conventionally used volatile organic solvents with PTFE will greatly enhance safety in the manufacturing of metal/fluorine compositions by the elimination of flammable/explosive solvents. This should also lead to cost savings in the overall manufacturing process by allowing for the rapid blending of the components into a homogenous mixture. Water, when used in the blending process, can be easily removed and disposed of safely and economically.

Although the specific examples described herein are primarily restricted to aluminum as the metal fuel, the invention is not so limited and it is to be understood that magnesium, titantium and zirconium can be used for the metal fuel in each of the examples, as so desired. Also, other fluorocarbon compounds that can be prepared or blended as water emulsions or fluid materials in the practice of the present invention, include PTFE, fluorinated polyethers, and fluorinated hydrocarbon polymers based on monomers other than ethylene. Examples of these additional materials include hexafluoropropylene and vinylidene fluoride. In addition, compositions containing blends or copolymers of these various polymers are also considered to be included in the scope of the present invention.

These and other modifications and variations of the specific Examples described herein will be readily apparent to those skilled in the art in the light of the above teachings. It is therefore to be understood that, within the scope of the appended claims, the invention may be practiced other than as described herein.

What is claimed as new and desired to be secured by Letters Patent of the United States is:

1. An energetic composition comprising a mixture of a fluorelastomer terpolymer latex and a metal fuel;

said fluorelastomer comprising an emulsion of fluorinated terpolymer fluoroelastomer in water; and said emulsion containing at lest 70% solids, by weight, and said solids containing at least 68% fluorine, by weight, wherein following evaporation of the water, said composition readily ignites and burns.

2. The energetic composition of claim 1 wherein said metal fuel is selected from the group of metal fuels consisting of aluminum, magnesium, titanium and zirconium powders.

3. The energetic composition of claim 2 wherein said metal fuel is aluminum powder having a particle size in the range of 3–10 microns.

4. The energetic composition of claim 3 wherein the ratio of fluorinated terpolymer fluoroelastomer to aluminum powder is 4:1 parts, by weight.

* * * * *